US011661226B2

(12) United States Patent
Yoon

(10) Patent No.: US 11,661,226 B2
(45) Date of Patent: May 30, 2023

(54) WRAPPING ROBOT WITH ENHANCED SAFETY AND RELIABILITY

(71) Applicant: Myoung-Koo Yoon, Paju-si (KR)

(72) Inventor: Myoung-Koo Yoon, Paju-si (KR)

( * ) Notice: Subject to any disclaimer, the term of this patent is extended or adjusted under 35 U.S.C. 154(b) by 82 days.

(21) Appl. No.: 17/367,374

(22) Filed: Jul. 4, 2021

(65) Prior Publication Data

US 2022/0348373 A1 Nov. 3, 2022

(30) Foreign Application Priority Data

Apr. 28, 2021 (KR) ..... 10-2021-0054843

(51) Int. Cl.

| | |
|---|---|
| ***B65B 57/08*** | (2006.01) |
| ***B65B 11/02*** | (2006.01) |
| ***B65B 57/18*** | (2006.01) |
| ***B65B 65/02*** | (2006.01) |

(52) U.S. Cl.

CPC ..... *B65B 57/08* (2013.01); *B65B 11/025* (2013.01); *B65B 57/18* (2013.01); *B65B 2210/14* (2013.01)

(58) Field of Classification Search

None

See application file for complete search history.

(56) References Cited

U.S. PATENT DOCUMENTS

| | | | | |
|---|---|---|---|---|
| 4,067,174 A * | 1/1978 | Goldstein | B65B 11/025 53/210 |
| 2004/0240975 A1* | 12/2004 | Baraggioli | B65B 11/025 414/495 |
| 2013/0061558 A1* | 3/2013 | Klear | B65B 11/025 53/218 |
| 2018/0194503 A1* | 7/2018 | Luo | B65B 57/16 |
| 2018/0229867 A1* | 8/2018 | Brizek | B65B 11/008 |
| 2021/0039815 A1* | 2/2021 | Martin | B65B 41/16 |
| 2021/0253284 A1* | 8/2021 | Battistoni | B65B 57/00 |
| 2022/0135263 A1* | 5/2022 | Laghi | B65B 41/14 53/461 |

FOREIGN PATENT DOCUMENTS

| | | | | |
|---|---|---|---|---|
| CN | 104369892 A * | 2/2015 | B65B 11/025 |
| EP | 3070003 A1 * | 9/2016 | B65B 11/006 |
| KR | 10-1993-0012512 A | 12/1993 | |
| KR | 10-1095379 B | 12/2011 | |
| KR | 10-1111674 B | 1/2012 | |
| KR | 10-2017-0062147 A | 6/2017 | |
| KR | 10-1755004 B | 6/2017 | |
| WO | WO-2020165721 A1 * | 8/2020 | |

* cited by examiner

*Primary Examiner* — Hemant Desai

*Assistant Examiner* — Tanzim Imam

(74) *Attorney, Agent, or Firm* — Mark M. Friedman

(57) ABSTRACT

The present invention provides a wrapping robot with enhanced safety and reliability, the wrapping robot being able to prevent a safety accident that occurs when a worker or another object hits against a handle protruding outward from a robot body while the robot revolving around a product to perform wrapping by biasing the handle toward the product to be wrapped; and being able to improve reliability of wrapping by stopping operation of the wrapping robot when a wrap is loosened or cut during wrapping, using a sensor that senses loosening or cutting of a wrap.

6 Claims, 7 Drawing Sheets

WRAPPING ROBOT WITH ENHANCED SAFETY AND RELIABILITY

BACKGROUND OF THE INVENTION

Field of the Invention

The present invention relates to a wrapping robot and, more particularly, to a wrapping robot with enhanced safety and reliability, the wrapping robot improving work safety by changing the position of a handle and inclining a mast equipped with a wrap, and improving reliability of wrapping by mounting a sensor that senses whether a wrap is loosened or is cut during wrapping.

Description of the Related Art

When products (referring to an object to be wrapped, the same hereafter) are sold, transported, or stored, the outside of the products are wrapped with thin vinyl for wrapping (referred to as a 'wrap' herein) to avoid damage while the products are transported or stored. In order to wrap a product, as the front end of a wrap wound in a cylindrical roll shape on a spool is pulled, the spool with the wrap wound thereon is rotated and the wrap is unwound, thereby wrapping the product.

As for the technology proposed about apparatuses for wrapping products, a "wrapping machine for film" has been disclosed in Korean Patent Application Publication No. 1993-12512. According to the wrapping machine, a wound wrap is mounted on a lifer fixed to supporting columns, a product is placed on a turntable disposed inside the supporting columns, and then the turn table is rotated. Accordingly, the wound wrap is unwound and wraps the product.

Further, a "wrapping machine and method for wrapping a plastic foil web around an object" has been disclosed in Korean Patent No. 1111674. According to this technology, a frame is formed by vertically disposing four columns, a base on which a product is seated is disposed inside the frame, and a foil dispenser is mounted on a circular guide track fixed to the four columns constituting the frame, whereby the wrapping machine is configured. Further, when the foil dispenser is rotated along the circular guide track with a product seated on the base, the wound foil (wrap) is unwound and wraps the product seated on the base inside the frame.

Not only the above patents, but most apparatuses for wrapping a product that have been disclosed up to now are configured such that a product is moved and seated on a base (a turntable, or the like) disposed inside supporting columns (or a frame) and a wound wrap is revolved around the product or the product seated on the base is rotated, whereby the wound wrap wraps the product while being unwound.

Accordingly, since a product has to be seated inside the frame of wrapping machines, the size of products that can be wrapped is limited, so large products such as a product on a pallet or a pallet on which several boxes are stacked cannot be wrapped. Further, tension does not uniformly act in the entire wrap depending on the sizes and shapes of products, so wrapping may not be uniform. Further, since it is required to move and seat a product inside a frame to wrap the product, additional preparation work is required before wrapping. Further, since wraps are very thin, the wraps are loosened or cut during wrapping in many cases at sites. Wrapping machines keep operating until a worker recognizes the situation and takes measures even when a wrap is loosened or cut during wrapping, so there is a problem that products are not wrapped well due to loosening of the wrap or are never wrapped at all due to cutting of the wrap.

According to most apparatuses for wrapping disclosed up to now, since a wrapping machine is fixed at a specific place and wrapping is performed after a product is carried to the wrapping machine, there is a problem that it is impossible to wrap a product at a certain place unless the product is carried to the place where the wrapping machine is. Accordingly, in order to wrap products, which are placed at certain places and having various sizes and shapes, at the places where the products are, it is urgent to develop a wrapping robot that can go to the products and can accurately, uniformly, and reliably wrap the products while recognizing the sizes and shapes of the products at the places where the products are.

SUMMARY OF THE INVENTION

The present invention has been made in an effort to solve the above problems, and an object of the present invention is to provide a wrapping robot with enhanced safety and reliability that can improve work safety by preventing a safety accident that occurs when a worker or another product hits against a handle protruding outward from a robot body while the wrapping robot revolves around a product to wrap the product, by disposing the handle not at the center of the robot body, but by biasing the handle toward the product to be wrapped.

Another object of the present invention is to provide a wrapping robot with enhanced safety and reliability that can improve work safety because it is prevented from being turned over or separated out of the route due to tension pulling a wrap by inclining a mast, which is equipped with a spool with the wrap wound thereon, in the opposite direction to the pulling direction of the wrap, and that can improve reliability of wrapping by stopping the operation thereof when the wrap is loosened or cut during wrapping, using a sensor that senses loosening or cutting of the wrap that is wrapping a product.

A wrapping robot with enhanced safety and reliability according to the present invention includes: a robot body having a battery and a driving motor in a box-shaped inside and having moving wheels on the bottom to be movable; a controller including operation buttons and switches for inputting operation conditions and operating the wrapping robot and a display showing work conditions and states, disposed on the top of the robot body to control operation of the wrapping robot; a handle protruding forward from the robot body to be used to move the wrapping robot to a specific place; a guide wheel protruding from under the handle toward a position where a product to be wrapped is placed and guiding movement of the wrapping robot, which performs wrapping while revolving around a product, by rotating in contact with the surface of the product; and a mast installed in a column shape at the center portion of the rear of the robot body, having a spool that has a wrap wound in a roll shape thereon, installed behind the column to unwind and supply the wound wrap, and can move up and down on the column.

Preferably, the handle is biased toward the position where a product to be wrapped is placed by ⅓ to ¼ of the length of a side from the center of the side on which the handle is installed in the box shape of the robot body.

Preferably, the mast is inclined at 3 to 13° forward from the robot body, that is, in the opposite direction of the pulling direction of the wrap.

Preferably, a wrap conveying-tension sensing unit that senses tension while conveying the wrap that is supplied when the wrap wound on the spool is unwound and supplied is further installed behind the mast.

Preferably, the wrap conveying-tension sensing unit includes: a guide roller guiding a wrap wound on the spool when the wrap is unwound and conveyed; a pulling roller pulling a wrap that is conveyed through the guide roller while being rotated by power from the driving motor; a moving roller installed between the guide roller and the pulling roller and maintaining tension of a wrap that is conveyed while rotating with the pulling roller; and a frame having a ⊏-shaped cross-section and having the guide roller, the pulling roller, and the moving roller between a top plate and a bottom plate thereof. Further, first and second gears are disposed on central shafts of the pulling roller and the moving roller, respectively, and are in mesh with each other, whereby the pulling roller and the moving roller are rotated together by power from the driving motor. Further, slots are formed at the portions in which the central shaft of the moving roller is inserted at the top plate and the bottom plate of the frame so that the moving roller moves close to or away from the pulling roller while the central shaft of the moving roller moves in the slots.

Preferably, the wrap conveying-tension sensing unit further includes: a sensor bracket formed in a plate shape having a predetermined length and width, and installed on the side of the upper portion of the pulling roller; a fixed shaft installed through the plate-shaped sensor bracket with an end fixed to the top plate of the frame, and enables the sensor bracket to rotate within a predetermined range about the shaft; a sensor roller installed on the bottom of the end, which is far from the pulling roller, of the sensor bracket and guiding the wrap supplied through the pulling roller to be conveyed toward a product; a spring installed to connect the end opposite to the end of the sensor bracket at which the sensor roller is installed and the top plate of the frame to each other, and stretching and contracting, depending on tension of the wrap that is conveyed through the sensor roller, such that the sensor bracket rotates about the fixed shaft; and a sensor installed under the top plate of the frame and sensing the position of the sensor bracket to make it possible to determine the tension of a wrap that is conveyed.

Preferably, when the sensor bracket is positioned in a range in which the sensor bracket can be sensed by the sensor, it is determined as an abnormal state in which a wrap is loosened or cut, and the wrapping robot is controlled to stop operating. Further, when a wrap is loosened or cut, light or alarm is generated so that a worker can visually or aurally recognize the situation.

DETAILED DESCRIPTION OF THE PREFERRED EMBODIMENTS

The wrapping robot according to the present invention is characterized in that a handle thereof is biased toward a product to be wrapped to be able to prevent a safety accident that occurs when a worker or another product hits against the handle during wrapping, in that the wrapping robot can be prevented from turning over due to tension that pulls a wrap by disposing a mast at an angle, and in that reliability of wrapping is increased by preventing the situation in which wrapping is performed without a wrap smoothly supplied by stopping the operation of the wrapping robot when the wrap is loosened or cut, using a sensor that senses whether the wrap is loosened or cut during wrapping.

A wrapping machine is a machine that is fixed and is configured to wrap a product by unwinding a wound wrap while rotating the product, which is carried to a predetermined position inside the wrapping machine, or is configured to wrap a product, which is fixed without rotating, while revolving around the product and unwinding a wound wrap. However, the wrapping robot according to the present invention is an apparatus that is equipped with a wrap, that is moved to products having various sizes and shapes and placed at certain places to be wrapped, and that automatically wraps the product by unwinding the wound wrap while revolving around the products by itself in accordance with a work instruction when work conditions are input thereto.

Figure 1:
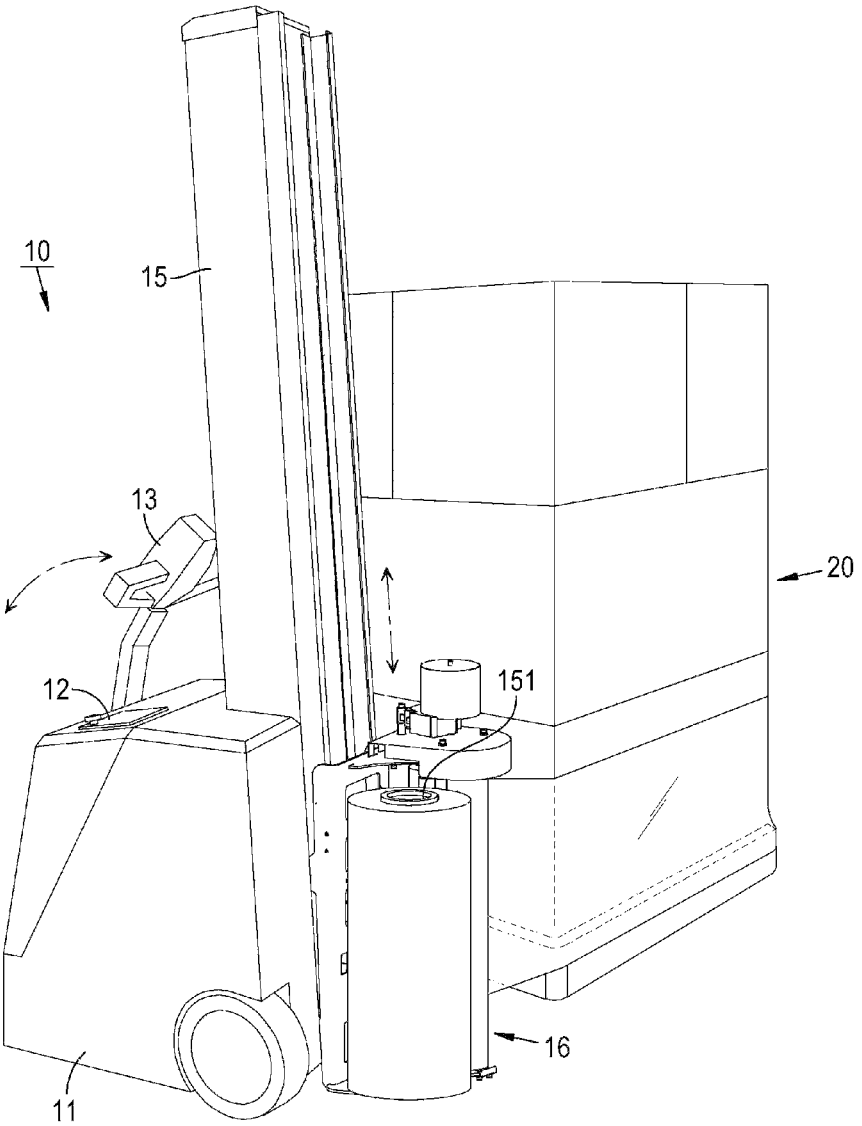
FIG. 1 is a perspective view showing a wrapping robot according to the present invention.
Figure 2:
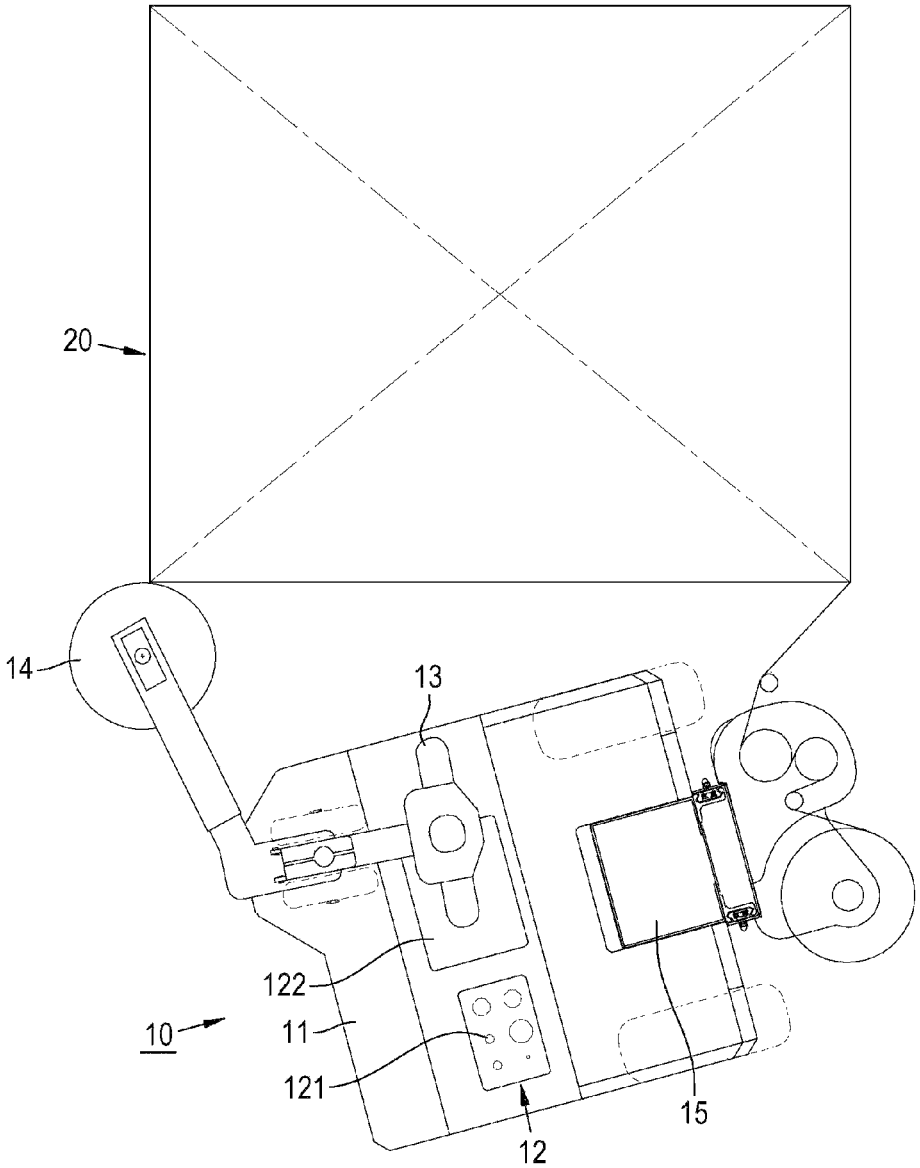
FIG. 2 is a plan view showing the wrapping robot that is wrapping a product while revolving around the product.
Figure 3:
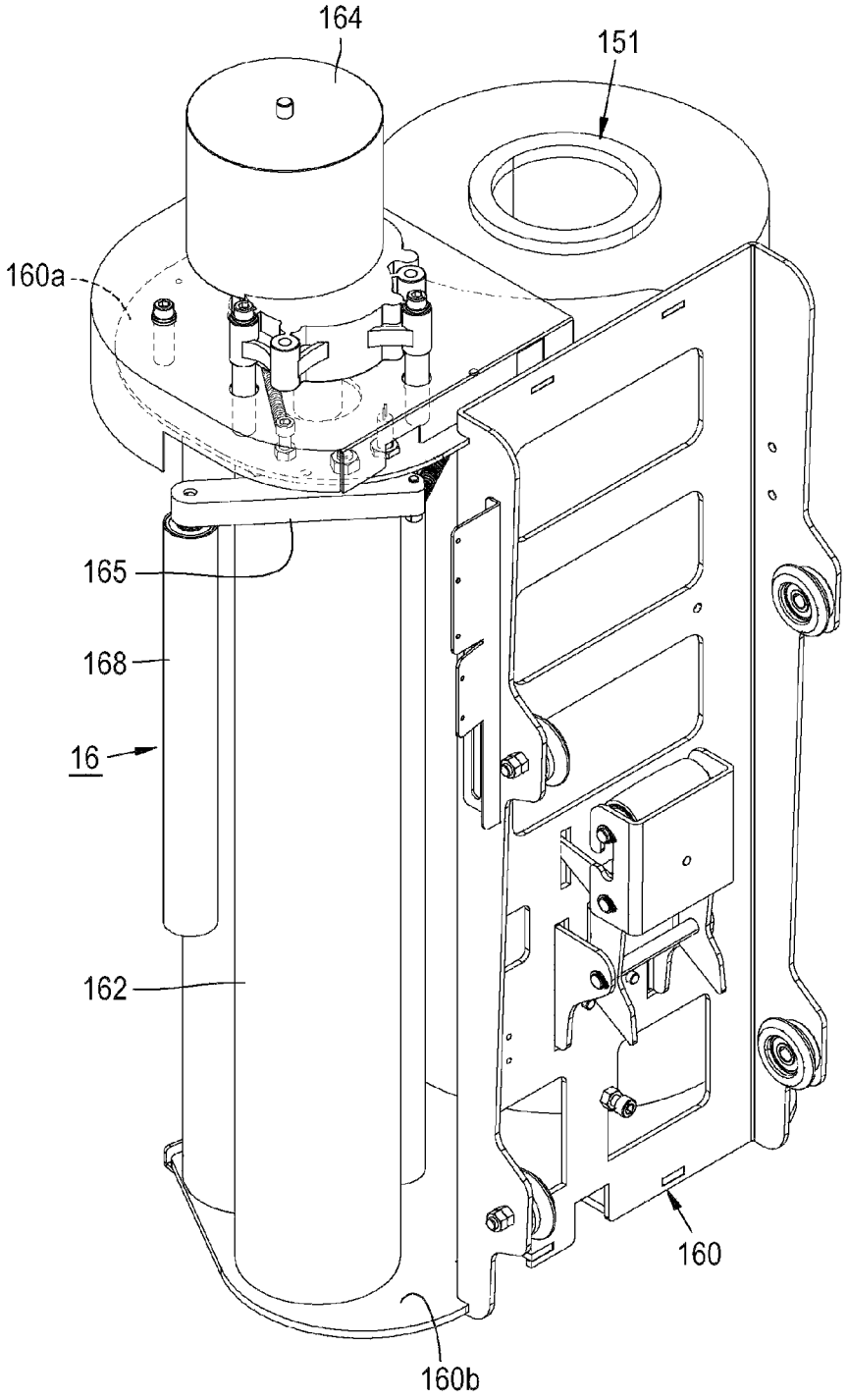
FIG. 3 is a view showing rollers and a frame including a wrap conveying-tension sensing unit.

A wrapping robot 10 according to the present invention, which is configured to wrap a product 20 to be wrapped while revolving around the product 20, fundamentally includes a robot body 11, a controller 12 for controlling operation the wrapping robot, a handle 13 for moving the wrapping robot, a guide wheel 14 for guiding movement of the wrapping robot in contact with the product to be wrapped, and a mast 15 equipped with a spool having a wrap wound thereon (see FIGS. 1 and 2).

The robot body 11 has components for operating the robot such as a battery and a driving motor in a box-shaped inside and has moving wheels on the bottom to be movable. The controller 12, which is provided to control operation of the wrapping robot, includes operation buttons 121 and switches for inputting operation conditions and operating the wrapping robot and a display 122 showing work conditions and states, disposed on the top of the robot body 11.

The handle 13 protrudes forward from the robot body 11 to be used to move the wrapping robot to a specific place. In general, handles are installed at the center of a side of a robot body. However, one of the technical characteristics of the wrapping robot 10 of the present invention is that the handle 13 is not installed at the center of a side of the robot body 11, but biased toward the position where a product 20 to be wrapped is placed by ⅓ to ¼ of the length of the side from the center of the side on which the handle 13 is installed in the box shape of the robot body 11 such that the post on which the handle 13 is installed at the upper end is installed to be folded toward the robot body 11.

Since the handle 13 is installed so that it pretty much protrudes forward from the robot body 11, an accident when a worker or another object around the product 20 hits against the protruding handle when the wrapping robot 10 performs wrapping while revolving around the product frequently occurs at sites. However, since the handle 13 is installed so that it is biased toward a product to be wrapped and is installed so that it is foldable toward the robot body 11 in the wrapping robot 10 according to the present invention, the handle does not protrude from the robot body 11 during wrapping, whereby it is possible to prevent a safety accident due to hitting against the protruding handle.

Since the outer surface of the guide wheel 14 should come in contact with not the ground, but a product to be wrapped, the wheel is horizontally installed. Further, when the wrapping robot 10 is operated for wrapping, the wheel guides movement of the wrapping robot 10 while rotating with the outer surface of the wheel being in contact with the surface of the product to be wrapped 20. Accordingly, the guide wheel 14 protrudes at the lower portion of a post on which the handle 13 is installed toward the position where a product to be wrapped is placed. Since the guide wheel 14 is provided, the wrapping robot 10 can automatically wrap a product to be wrapped while revolving around the product as long as work conditions are input even if there is no worker (see FIG. 2).

The mast 15 is a column installed at the center of the rear of the robot body 11. A spool 151 having a wrap wound in a roll shape thereon is installed behind the column, and an elevator for moving up and down the spool 151 and a wrap conveying-tension sensing unit 16 is installed on the column. The wrap wound on the spool 151 is supplied while being unwound and the spool 151 supplies the wrap while moving up and down on the column. Accordingly, even if the height of a product is much larger than the width of the wrap, the product can be wrapped without difficulty.

In general, almost all masts are vertically installed columns, a spool having a wrap wound thereon is installed behind the masts, and the wrap is pulled and wound rearward during wrapping. In this case, tension that pulls the wrap is applied and the vertically installed masts are pulled rearward. In particular, when a spool is moved up and the acting point of tension that pulls the wrap is moved higher at the mast, a safety accident that the wrapping robot is easily turned over or is separated out of the route while the front is lifted occurs. However, since the mast 15 is inclined at 3 to 13° forward from the robot body 11, that is, in the opposite direction of the pulling direction of the wrap in the wrapping robot of the present invention, it is possible to prevent the possibility of the safety accident described above (see FIG. 1).

Figure 5:
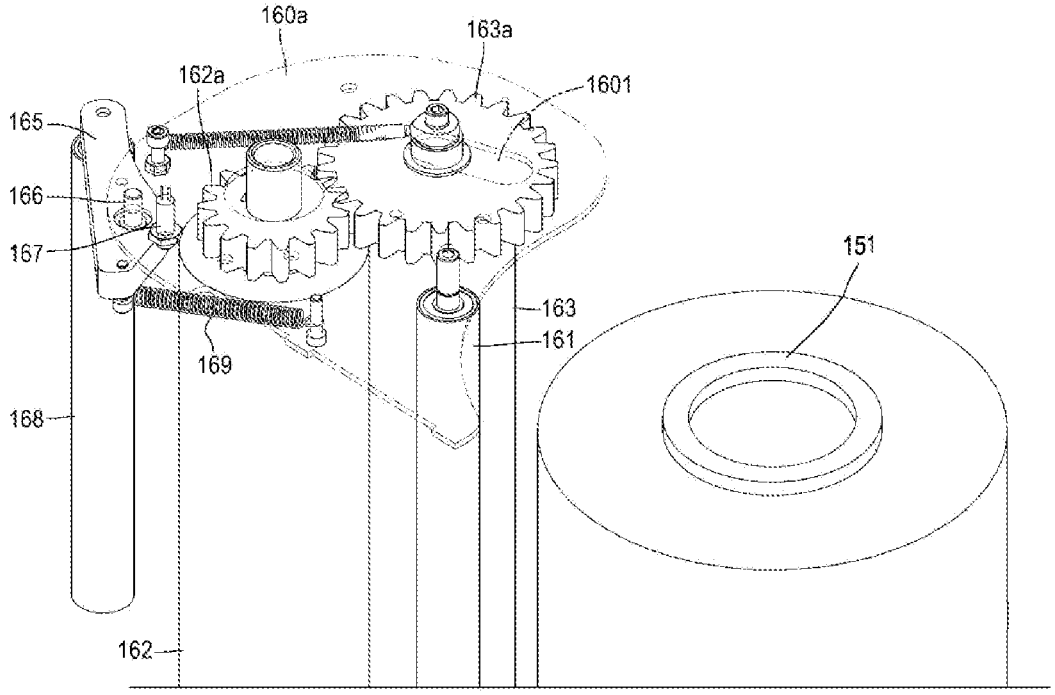
FIG. 5 is a view illustrating the arrangement and assembly relationships of the wrap conveying-tension sensing unit, a moving roller, and a pulling roller.
Figure 6:
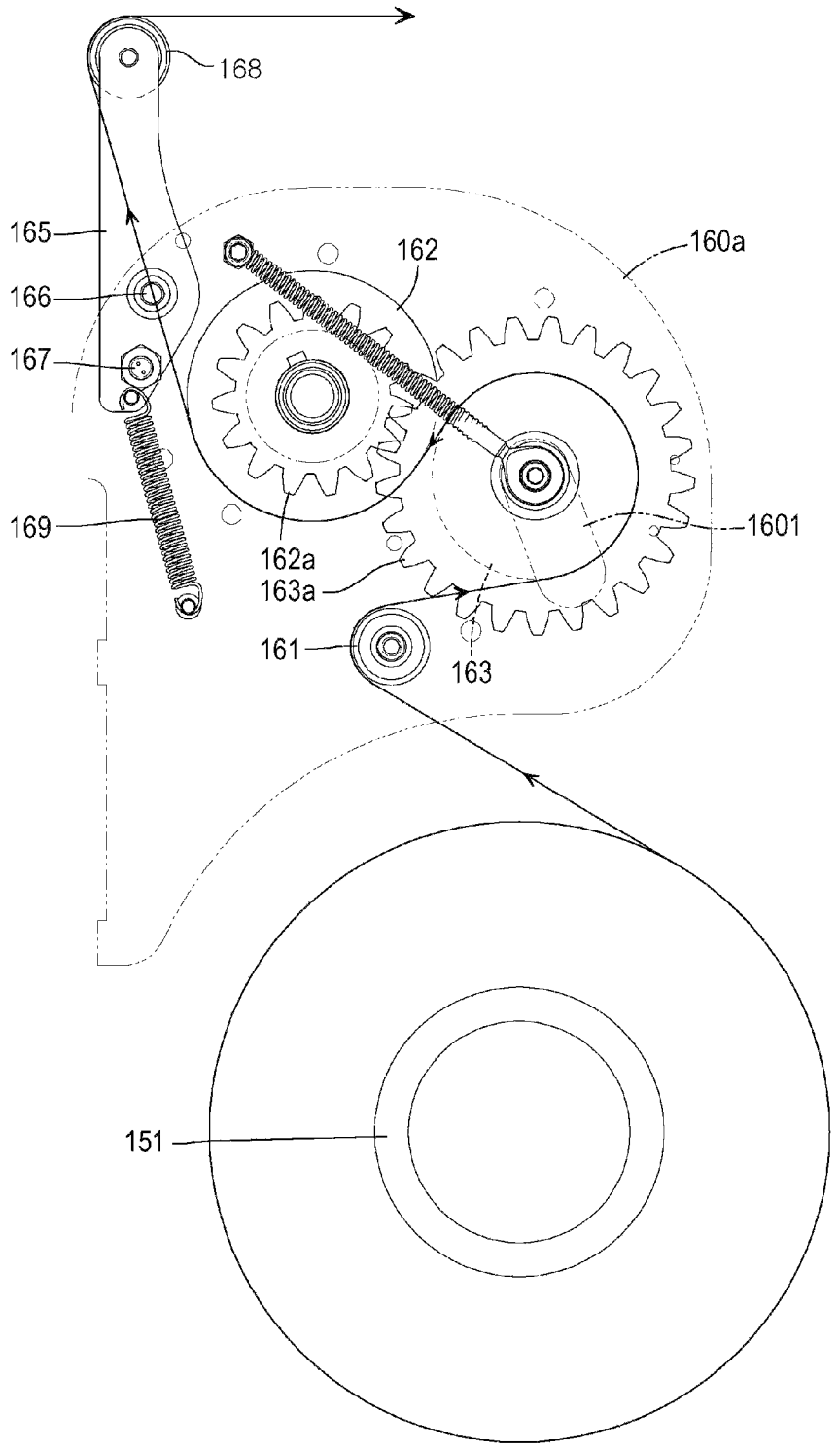
FIG. 6 is a view showing an abnormal state in which tension of a wrap is loosened.
Figure 7:
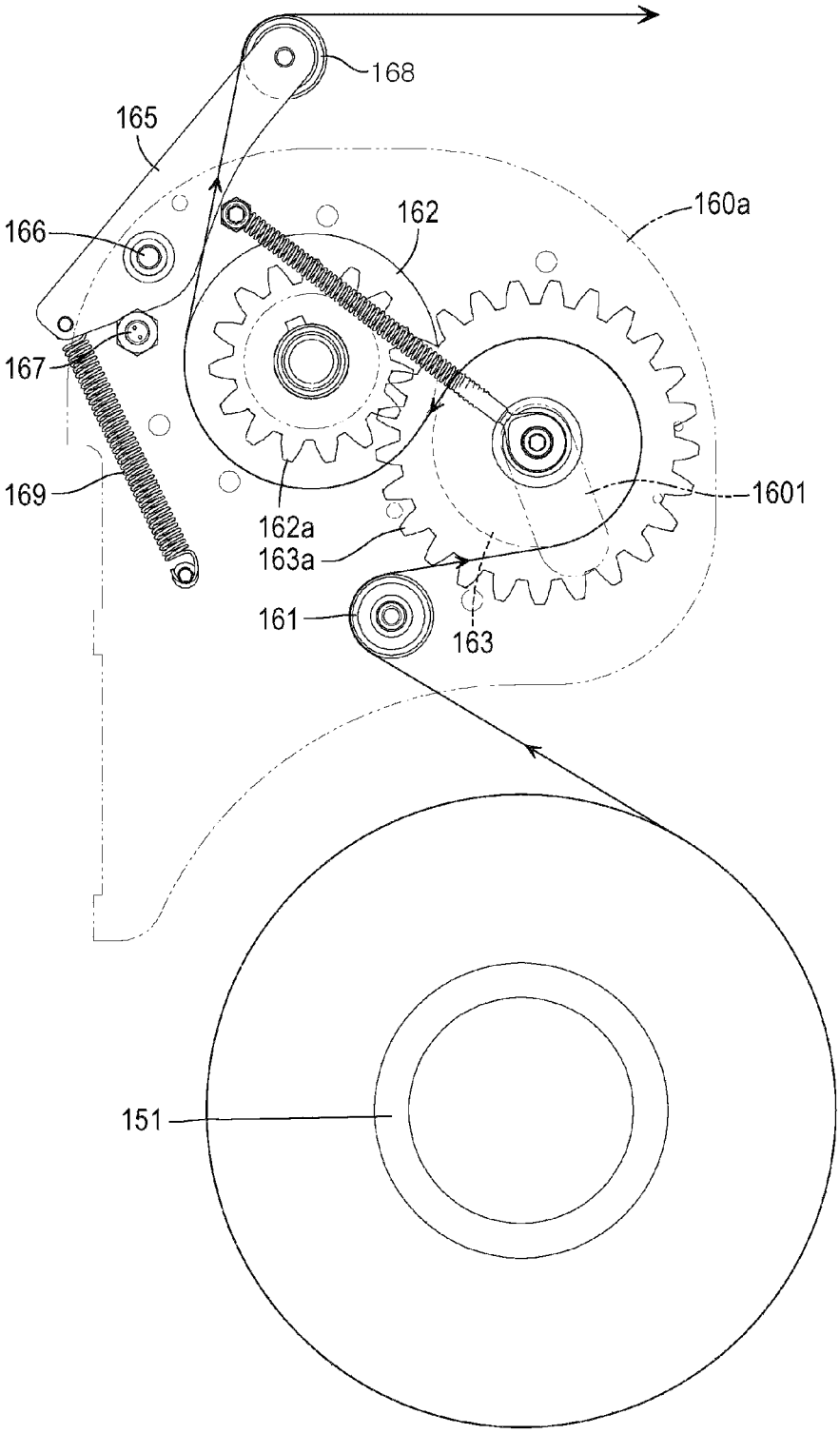
FIG. 7 is a view showing the state in which wrapping is normally performed.

It is preferable that the wrap conveying-tension sensing unit 16 that senses tension while conveying the wrap that is supplied when the wrap wound on the spool 151 is unwound and supplied is further installed behind the mast 15. The wrap conveying-tension sensing unit 16 fundamentally includes a guide roller 161 that guides a wrap that is conveyed, a pulling roller 162 that pulls a wrap, a moving roller 163 that can move to maintain tension of a wrap, and a frame 160 for installing the rollers (see FIGS. 5 to 7).

The guide roller 161 guides a wrap to the moving roller 163 when the wrap wound on the spool 151 is unwound and conveyed. The pulling roller 162 pulls the wrap conveyed through the guide roller 161 and the moving roller 163 while being rotated by the power generated by the driving motor 164 installed on the top plate 160*a* of the frame. The moving roller 163 is installed between the guide roller 161 and the pulling roller 162 and enables a conveyed wrap to maintain tension while rotating with the pulling roller 162. First and second gears 162*a* and 163*a* are disposed at the upper ends of the central shafts of the pulling roller 162 and the moving roller 163 and are in mesh with each other, so the pulling roller 162 and the moving roller 163 are rotated together by the power from the driving motor 164. The first and second gears 162*a* and 163*a* have different numbers of teeth so that the RPM of the pulling roller 162 is larger by about 1.5 times the RPM of the moving roller 163. Accordingly, when a wrap is pulled, the pulling roller 162 is rotated faster than the moving roller 163, whereby the wrap is effectively pulled (see FIGS. 6 and 7).

Figure 4:
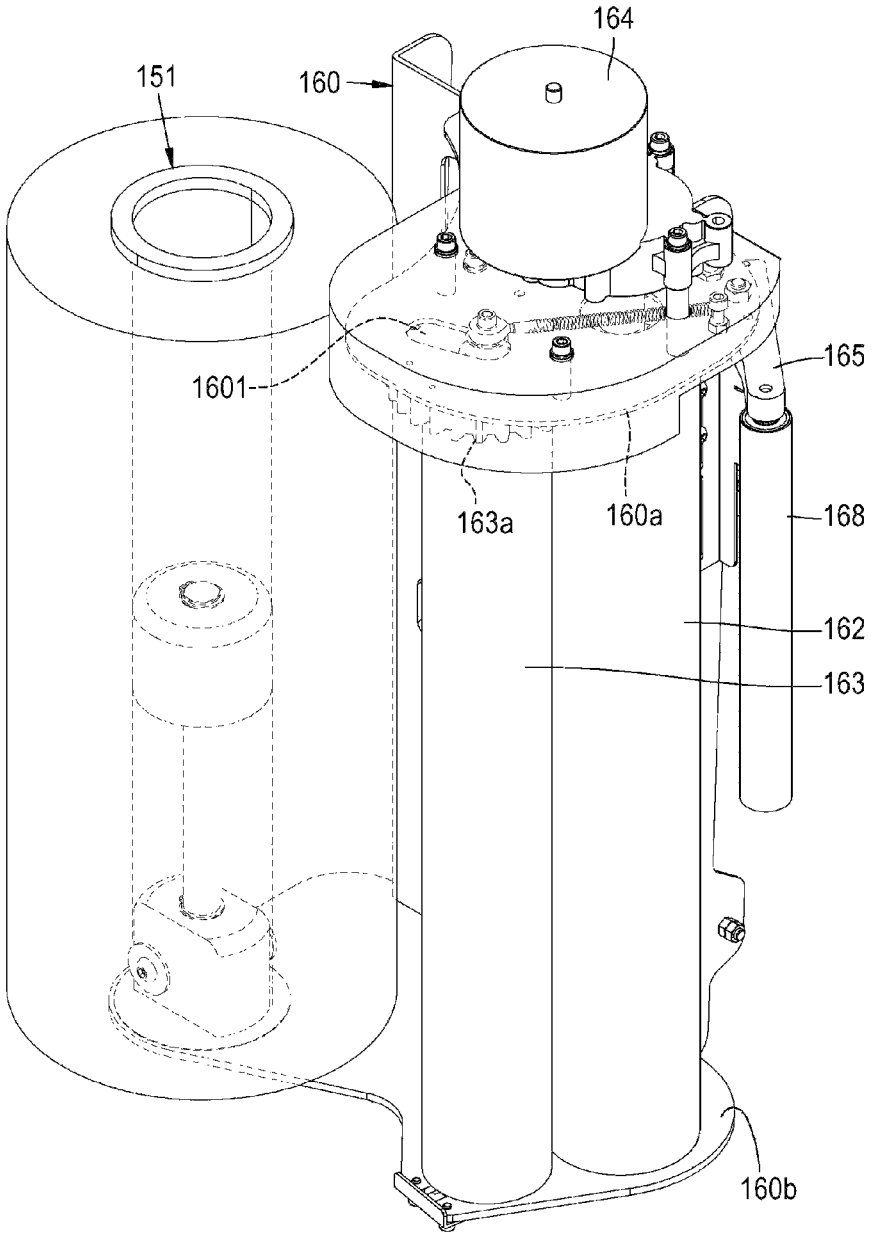
FIG. 4 is a view showing the arrangement state of the rollers and the frame including the wrap conveying-tension sensing unit.

The frame 160 has an entirely ⊏-shaped cross-section by coupling horizontal top plate 160*a* and bottom plate 160*b* to the upper and the lower end of a vertical side plate. The guide roller 161, the pulling roller 162, and the moving roller 163 are disposed between the top plate 160*a* and the bottom plate 160*b*. The spool 151 having a wrap wound thereon is installed at a side of the guide roller 161 on the bottom plate 160*b* (see FIG. 4).

It is preferable that, in the top plate 160*a* and the bottom plate 160*b* of the frame, slots 1601 having a predetermined length are formed at the portions in which the central shaft of the moving roller 161 is inserted so that the moving roller 163 can move close to or away from the pulling roller 162 while the central shaft of the moving roller 161 moves in the slots 1601. Since the moving roller 163 can move as described above, when a part of the worker's body or another object is stuck between the moving roller 163 and the pulling roller 162 while the wrapping robot 10 performs wrapping, the moving roller 163 is controlled to move away from the pulling roller 162 and wrapping robot 10 is controlled to stop operating, whereby it is possible to prevent industrial accidents due to safety accidents. Further, a worker can easily prepare for wrapping by putting a wrap between the rollers before wrapping.

One of the technical characteristics of the present invention is that since the wrap conveying-tension sensing unit 16 is installed, when a wrap is loosened or cut, tension of the wrap that is being conveyed is sensed and the operation of the wrapping robot 10 is stopped, thereby preventing the wrapping robot 10 from keep operating without wrapping being normally performed. To this end, the wrap conveying-tension sensing unit 16 further includes a sensor bracket 165, a fixed shaft 166, a sensor roller 168, a spring 169, and a sensor 167 (see FIGS. 5 to 7).

The sensor bracket 165 is formed in a plate shape having a predetermined length and width, is installed on the side of the upper portion of the pulling roller 162, and can be rotated within a predetermined range about the fixed shaft 166. The fixed shaft 166 is installed through the plate-shaped sensor bracket 165 with an end fixed to the top plate 160*a* of the frame, and enables the sensor bracket 165 to rotate within a predetermined range about the shaft.

The sensor roller 168 is installed on the bottom of the end, which is far from the pulling roller 162, of the sensor bracket 165 and finally guides the wrap supplied through the pulling roller 162 toward a product. The upper end of the central shaft of the sensor roller 168 is installed and fixed to the sensor bracket 165.

The spring 169 is installed to connect the end opposite to the end of the sensor bracket 165 at which the sensor roller 168 is installed and the top plate 160*a* of the frame to each other. The spring 169 stretches and contracts depending on tension of the wrap that is conveyed to a product to be wrapped through the sensor roller 168, and accordingly, the sensor bracket 165 rotates about the fixed shaft 166.

The sensor 167 is a tension sensor that is installed under the top plate 160*a* of the frame and senses the position of the sensor bracket 165 to make it possible to determine the tension of a wrap that is conveyed. When a wrap is loosened or cut, the spring 169 decreases in length while contracting and pulls the sensor bracket 165, so the sensor bracket 165 is moved into the range in which it can be sensed by the sensor 167 (see FIG. 6). When tension of a wrap is normal, the spring 169 increases in length while stretching (normal length), so the sensor bracket 165 is moved to a range in which it is not sensed by the sensor 167 (see FIG. 7).

When the sensor bracket 165 is positioned in the range in which it can be sensed by the sensor 167, it is determined as an abnormal state in which a wrap is loosened or cut, and the wrapping robot 10 is controlled to stop operating. In an abnormal state due to loosening of tension or cutting of a wrap as described above, it is preferable to generate light or alarm for a predetermined time so that a worker can visually or aurally recognize the situation. When an abnormal state is sensed, the wrapping robot 10 may be controlled to immediately stop operating. However, when a wrap is temporarily loosened, it may be possible to recover the tension of the wrap to the normal state by keep winding the wrap for several seconds. Accordingly, even though an abnormal state is sensed, the wrapping robot 10 may be controlled to stop operating after keep operating for several seconds.

When the sensor bracket 165 is not positioned in the range in which it can be sensed by the sensor 167, it is determined that the tension of a wrap is in a normal state.

According to the wrapping robot of the present invention, a handle protruding forward from the robot body is not disposed at the center of the robot body, but biased toward a product to be wrapped. Accordingly, it is possible to prevent various types of safety accidents such as that a person or another object around a product gets hurt or is damaged by hitting against the protruding handle when the wrapping robot wraps the product while revolving around the product or that the wrapping robot is turned over or separated from the route. Therefore, it is possible to remarkably improve work safety.

Further, when a spool having a wrap wound thereon is moved up to a higher position on a mast having a column shape, the acting point of tension pulling a wrap for wrapping is positioned higher on the mast. Accordingly, there is a high possibility of the wrapping robot being easily turned over or separating out of the route with the front lifted. However, according to the wrapping robot of the present invention, since the mast equipped with the spool having a wrap wound thereon is not vertically installed, but inclined in the opposite direction of the pulling direction of a wrap, tension pulling the wrap acts in the opposite direction to the inclination direction. Accordingly, the possibility of the robot being turned over or separating from the route decreases, whereby it is possible to considerably improve work safety.

Further, since a tension sensor is mounted to sense that a wrap is loosened or cut, the wrapping robot stops operating when a wrap is loosened or cut during wrapping. Accordingly, an abnormal state in which the wrapping robot keeps operating while revolving around a product without wrapping performed well due to loosening of a wrap or without a wrap supplied due to cutting of the wrap does not occur. Therefore, it is possible to improve reliability of wrapping.

The above description is provided as an example of the present invention and the embodiments described herein are provided to describe the present invention rather than limiting the spirit of the present invention, so the present invention may be changed and modified in various ways by those skilled in the art without departing from the scope of the present invention. Therefore, the protective range of the present invention should be construed by those described in claims and technical configuration in the equivalent range should also be construed as being included in the scope of the present invention.

What is claimed is:

1. A wrapping robot with enhanced safety and reliability that performs wrapping while revolving around a product to be wrapped, the wrapping robot comprising:

a robot body having a battery and a driving motor in a box-shaped inside and having moving wheels on its bottom to be movable;

a controller including operation buttons and switches for inputting operation conditions and operating the wrapping robot and a display showing work conditions and states, the controller disposed on a top of the robot body to control operation of the wrapping robot;

a handle protruding forward from the robot body to be used to move the wrapping robot to a specific place;

a guide wheel protruding from under the handle toward a position where a product to be wrapped is placed and guiding movement of the wrapping robot, which performs wrapping while revolving around the product, by rotating in contact with a surface of the product; and a mast installed at a center portion of a rear of the robot body, the mast having a spool that has a wrap wound in a roll shape thereon, the spool installed behind the mast to unwind and supply the wound wrap, the spool capable of moving up and down on the mast, wherein a wrap conveying-tension sensing unit that senses tension while conveying the wrap that is unwound and supplied is further installed behind the mast, wherein the wrap conveying-tension sensing unit includes:

a guide roller guiding the wrap wound on the spool when the wrap is unwound and conveyed;

a pulling roller pulling the wrap that is conveyed through the guide roller while being rotated by power from the driving motor;

a moving roller installed between the guide roller and the pulling roller and maintaining tension of the wrap that is conveyed while rotating with the pulling roller; and a frame having a ⊏-shaped cross-section and having the guide roller, the pulling roller, and the moving roller between a top plate and a bottom plate thereof, wherein first and second gears are disposed on central shafts of the pulling roller and the moving roller, respectively, and are in mesh with each other, whereby the pulling roller and the moving roller are rotated together by power from the driving motor, and wherein slots are formed at portions of the top plate and the bottom plate in which the central shaft of the moving roller is inserted so that the moving roller moves close to or away from the pulling roller while the central shaft of the moving roller moves in the slots.

2. The wrapping robot with enhanced safety and reliability of claim 1, wherein the handle is biased toward the position where the product to be wrapped is placed by ⅓ to ¼ of a length of a side of the robot body on which the handle is installed, from a center of the side.

3. The wrapping robot with enhanced safety and reliability of claim 1, wherein the mast is inclined at an angle of 3 to 13° forward from the robot body.

4. The wrapping robot with enhanced safety and reliability of claim 1, wherein the wrap conveying-tension sensing unit further includes:

a sensor bracket formed in a plate shape having a predetermined length and width, and installed on a side of an upper portion of the pulling roller;

a fixed shaft installed through the plate-shaped sensor bracket with an end fixed to the top plate of the frame, the fixed shaft enabling the sensor bracket to rotate within a predetermined range about the shaft;

a sensor roller installed on a bottom of an end of the sensor bracket which is far from the pulling roller, the sensor roller guiding the wrap supplied through the pulling roller to be conveyed toward the product;

a spring installed to connect an end of the sensor bracket opposite to the end of the sensor bracket at which the sensor roller is installed and the top plate of the frame to each other, the spring stretching and contracting, depending on tension of the wrap that is conveyed through the sensor roller, such that the sensor bracket rotates about the fixed shaft; and a sensor installed under the top plate of the frame and sensing a position of the sensor bracket to make it possible to determine the tension of the wrap that is conveyed.

5. The wrapping robot with enhanced safety and reliability of claim 4, wherein when the sensor bracket is positioned in a range in which the sensor bracket can be sensed by the sensor, it is determined as an abnormal state in which the wrap is loosened or cut, and the wrapping robot is controlled to stop operating.

6. The wrapping robot with enhanced safety and reliability of claim 5, wherein when the wrap is loosened or cut, light or alarm is generated so that a worker can visually or aurally recognize the abnormal state.

* * * * *